US005301703A

United States Patent [19]

Kahn

[11] Patent Number: 5,301,703

[45] Date of Patent: Apr. 12, 1994

[54] CANE TIP

[76] Inventor: Melvin Kahn, 467 Central Ave., Alameda, Calif. 94501

[21] Appl. No.: 86,613

[22] Filed: Jul. 2, 1993

[51] Int. Cl.[5] ..... A45B 9/04

[52] U.S. Cl. ..... 135/77; 135/84; 135/911

[58] Field of Search ..... 135/77, 82, 84, 85, 135/65, 911

[56] References Cited

U.S. PATENT DOCUMENTS 2,192,040 2/1940 Harris ..... 135/77
3,199,819 8/1965 Widmark ..... 135/77 X
3,467,117 9/1969 Lucibello ..... 135/77 X
4,958,651 9/1990 Najm ..... 135/82

*Primary Examiner*—Carl D. Friedman
*Assistant Examiner*—Lan C. Mai

[57] ABSTRACT

A cane has a tip at its bottom end, which tip is in the shape of a hemispherical shell. The cane is for the use of a visually handicapped person. When slid along the ground as the person walks, it provides auditory and kinesthetic clues about the environment and any impediments in the path of the user, yet cannot get caught, stuck or hung up on any obstacles.

18 Claims, 2 Drawing Sheets

CANE TIP

BACKGROUND OF THE INVENTION

1. Field of the Invention

This invention relates to canes for the use of the visually impaired, and specifically as an addition to the traditional cane used by this population to permit greater awareness of obstacles and impediments in the path of the user.

2. Description of the Prior Art

A blind or visually handicapped person uses a cane for the purpose of sensing that an obstacle, danger, or other form of hinderance is imminent.

Heretofore, users tapped and swung the cane from side to side in an arc in front of the user. The tapping occurs at the extreme left and the extreme right sides of the arc, the width of the swing determined by the width of the user's body. If the arc is sufficiently wide, then the cane will encounter an obstacle prior to its being hit by the person's body, thus allowing the person to stop or otherwise deal with the encounter.

The tapping at each end of the arc is to inform the traveler of the kind of terrain being traversed and to find any depressions or rises in the surface, such as holes or pits or steps that could cause the person to fall. The cane has to be tapped and then immediately raised above the surface being walked upon, lest the cane get caught, stuck or hung up on an obstacle. Thus, the user makes a quick tap at the end of each arc and the arc is made high enough to bring the cane above the surface or walking media until it comes down on the other side where it is likewise tapped again and then returned to the opposite side. This procedure is repeated until the person stops walking. Objects not falling within the tapping range of the cane are not detected. E.g., puddles, holes in the ground, and objects directly in the path of the user, which are large enough to trip over, but not large enough to be detected by the cane in its arc will not be detected. In the tap and swing technique, the cane is travelling through the air in its arc from side to side most of the time. This means that the terrain itself is not continuously sampled. Since the cane tip remains above the surface, the flow of information is not constant or immediately discernable with every change in terrain.

Prior canes used tips of various forms including wheels and rollers to improve their usefulness. None of the devices are well adapted for use on a variety of surfaces, from city pavements, to grassy areas, to uneven surfaces. These tips could still be caught in cracks in pavement, or in other obstacles they might encounter as they are swung from side to side.

The wheel or roller are meant to be used with constant contact with the surface being walked upon, and hence does not allow the user to have awareness laterally before him or her during walking, since the device is merely pushed forward. They are easily hung up and are suddenly stopped by cracks in the surface or larger holes as well as by vegetation on or to the sides of the walkway. "Wheel" canes must have a fairly smooth and continuous surface. Gravel, earth, sand, brick, cobblestones, etc., are not conducive to the use of a wheel or roller.

The invention provides an improved cane for use by the visually handicapped, and more specifically provides a cane whose tip shape allows the user to have it in continuous contact with the ground as it is moved from side to side. The invention provides a cane whose tip allows the user to avoid entanglement with objects or crevices in the path, which allows the visually impaired to walk in any terrain, to receive kinesthetic clues through the vibration of the cane as it traverses the terrain, to receive auditory clues as sound is reflected from its surface and to receive sufficient indication of impending change, e.g., puddles, construction barriers, curbs, etc. Acoustically the reverberations of the tip assist the user in detecting objects much in advance of physically contacting them.

Users of traditional canes can quickly learn to use this modified technique.

It is an additional object of the invention to provide a cane which produces a sound as it moves along the ground, thereby to serve as notice to other pedestrians that someone is approaching.

The vibration running through the tip of the cane into the hand of the traveler makes this cane valuable to a deaf-blind user. The constant sensation of knowing by feeling through the hand the nature of the surface gives the deaf-blind user otherwise unknown information and a greater sense of confidence.

Further objects and advantages will become apparent from a consideration of the ensuing description and accompanying drawings.

SUMMARY OF THE INVENTION

Briefly, the invention provides for a cane and tip therefor wherein the cane tip is comprised of a contact element having an outwardly facing convex surface which is relatively broad in relation to the diameter of the shank of the cane to which it is attached. Preferably, the contact element is in the form of a shell, suitably a hemispherical shell, having an interior hollow region behind its contact surface which tends to amplify or reinforce acoustic vibrations generated when the shell contacts objects in its path of travel.

In a further aspect of the invention a second reflector shell, preferably also hemispherical, is provided on the shank of the cane behind the contact shell. Like the contact shell, the reflector shell also has an interior hollow region. The two shells are arranged such that their interior hollow regions face each other so as to produce a reverberation region between the shells which further reinforces acoustical vibrations. The reinforced vibrations will be more easily detected by the handicapped person using the cane.

DETAILED DESCRIPTION OF THE ILLUSTRATED EMBODIMENT

Figure 1:
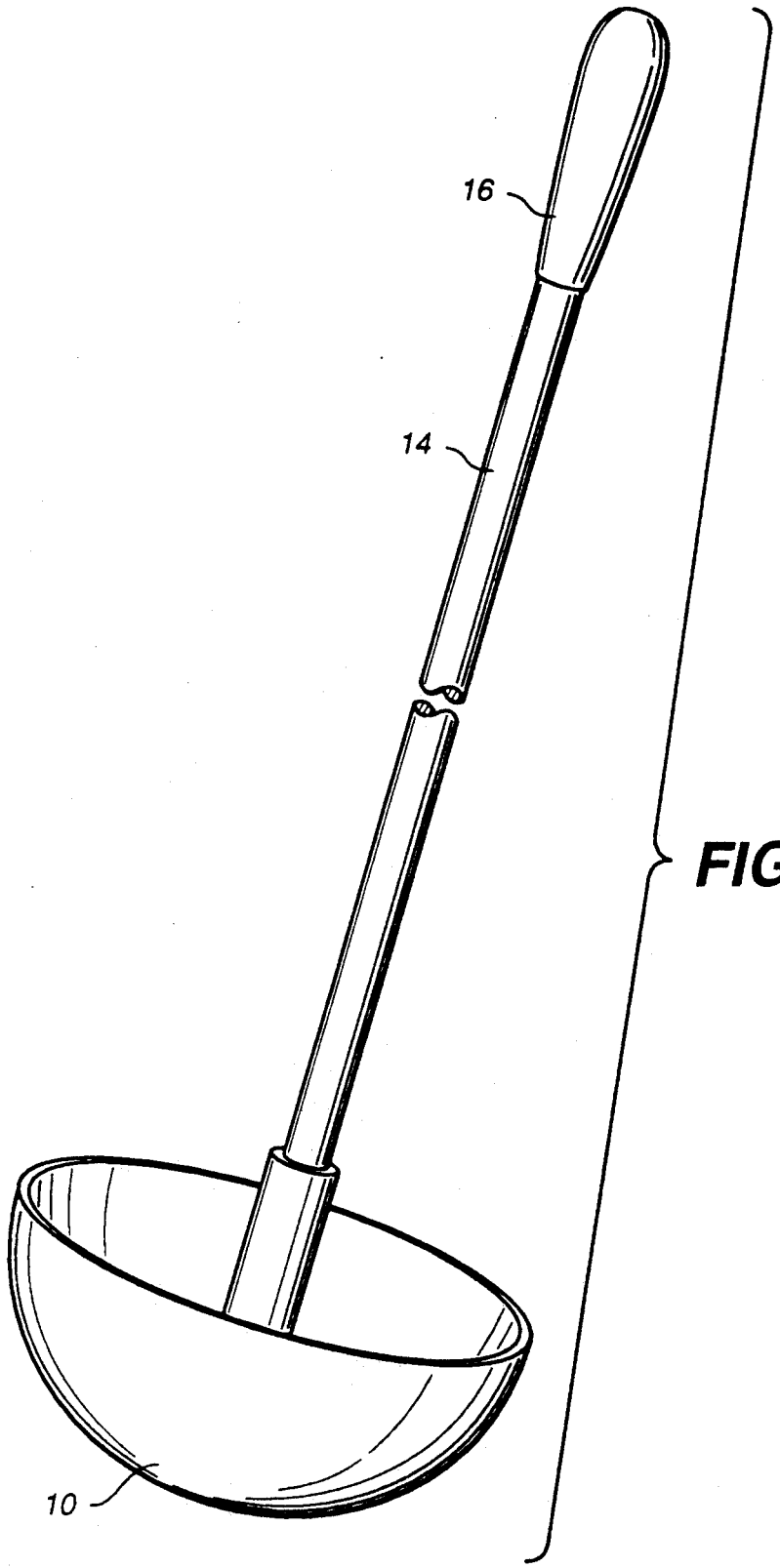
FIG. 1 is a perspective view of a cane with a novel tip according to the invention.
Figure 2:
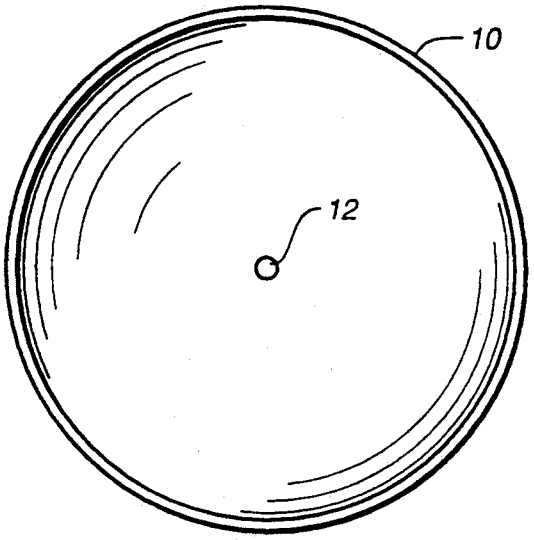
FIG. 2 is a partial side view of the cane of FIG. 1.
Figure 3:
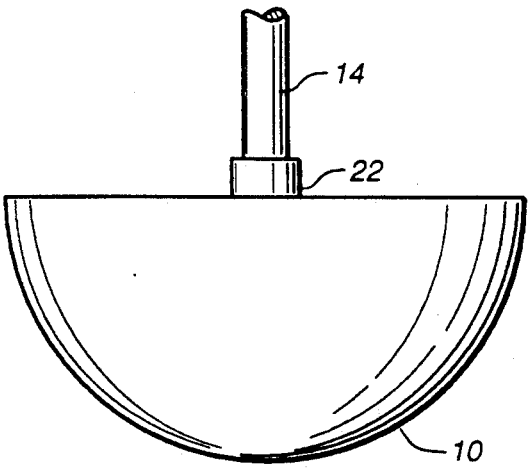
FIG. 3 is a top plan view of the cane shown in FIG. 1.

Referring now to the drawings, FIGS. 1–3 show cane 8 having shank 14 provided with a tip 10 which consists of a contact element which in turn is preferably in the form of a hollow hemispherical contact shell 11 attached by a screw or bolt 12 to the bottom end 15 of the shank. If shank is hollow, a wooden or plastic plug (not shown) can be inserted into its bottom end 15. FIG. 1 shows the entire length of the shank which has a gripping end 16.

The contact shell 11 is seen to have a relatively large diameter compared to the diameter of the cane's bottom end 15 to which it is attached. It also has an outwardly facing convex contact surface 19 which contacts impediments in the path of the cane as the tip of the cane is moved from side to side over the ground. The convex surface reduces the tendency of the tip of the cane to hang up on objects or impediments; it also creates an internal hollow region 21 behind the contact surface 19 which acts to reinforce the acoustical vibrations produced by the shell 11 when the shell strikes an object or impediment. This makes it easier for the user of the cane to detect what is in front of him or her.

Figure 4:
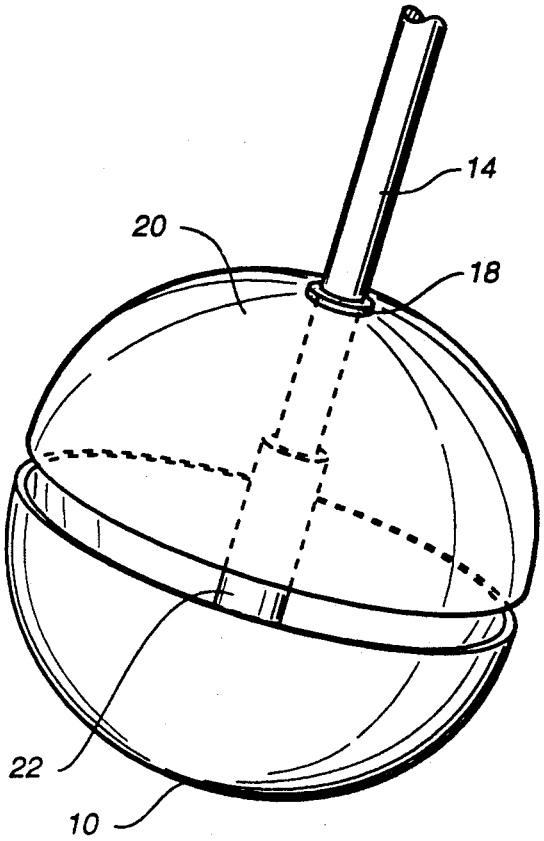
FIG. 4 is a partial perspective view of the cane of the invention showing an alternative embodiment of the cane tip.

FIG. 4 shows an alternative embodiment of the invention wherein a reflector shell 20 is secured to shank 14 by washers 18 in spaced relation above the lower contact shell 11. The washers 18 can be force fit and/or glued to the shank to prevent movement of the reflector shell on the shank. By arranging the two shells 11, 20 so that their interior hollow regions 21, 25 face each other, a reverberation chamber is provided between the shells which enhances the acoustical and kinesthetic qualities of the cane.

Figure 5:
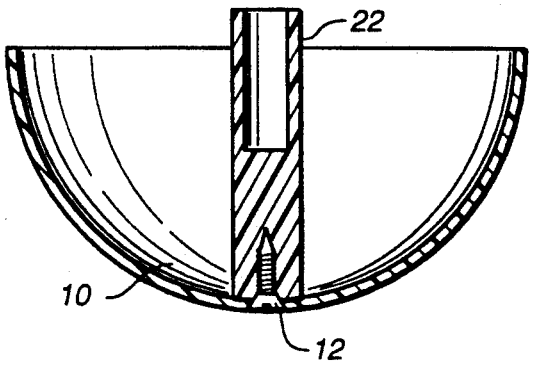
FIG. 5 is a cross-sectional view in side elevation of a cane tip in accordance with the invention showing the use of a nylon sleeve for attachment to the cane.

FIG. 5 shows a cane tip 10 having an insert element 22 attached by screw 26 to the bottom of shell 11. A tip provided with such an insert element, which is suitably a nylon insert, can be readily attached to the bottom end of the shank of a cane.

The material used for the shells 11, 20 may be plastic, fiberglass, or metal. The material should be sturdy and thick enough to resist denting, tearing, etc., in normal, daily use. The diameter of the hemisphere for use on ordinary hard or semi-hard surfaces (pavement, interior flooring or carpeting) is preferably about 7.5 cm. This may be varied for special circumstances (uneven unpaved areas) and the diameter adjusted to meet these special circumstances. E.g., the diameter may be reduced to 5 cm. when travel is indoors or on very even surfaces and a compact cane is preferable. The diameter should be as large as 20 cm. when used on plowed fields, areas planted in rows, e.g., vegetable gardens, orchards, etc. Diameters below 5 cm. are not recommended since the advantages of the invention would be diminished for tips smaller than this dimension.

In the FIG. 5 embodiment, the spacing between the hemispherical shells should be chosen to give the best acoustic and kinesthetic response. For shells having a 7.5 cm. diameter, a spacing, i.e., the width of gap 24, of approximately 2 cm., is recommended.

The hollow shell can be manufactured with the shank or retrofitted to any cane in use by the visually handicapped.

OPERATION

The user holds the cane in the customary way, except that instead of tapping and lifting, he or she keeps the tip in continuous contact with the ground by sliding it laterally left and right as he or she walks, and thereby determines the presence of objects in the path. Changes in the terrain, curbs, holes and cracks are detected without the risk of the cane becoming entangled or jammed by what it encounters. The user receives auditory clues generated by the hollow sphere resounding against what it encounters, adding addition information on the environment for the user. The noise generated also serves as a warning to other pedestrians that someone is approaching. The deaf blind feel augmented vibrations from the hollow sphere, enabling them to determine the conditions in their environment kinesthetically. Blind children will have less difficulty in learning to use a cane tipped with the hollow sphere since the coordination is much easier.

Thus, it can be seen that the cane tip of this invention provides a safe, easy to use instrument for the use of the visually handicapped and deaf blind which will enable him or her to travel in the sighted world with more assurance and that it will open vistas, enabling the user to travel faster and in a wide variety of terrains, e.g., beaches and other sandy areas, plowed fields, grass, gravel, and muddy areas.

As stated, the tip can be manufactured with the cane or sold as a retrofit to replace existing rubber and metal tip. The hemispherical contact shell 11 can be attached in other ways, e.g., by adhesive. It can be made integral with the shank, e.g., by having the shank taper out to the hemisphere, which can be solid or can have a closed upper surface. The hemisphere can be made into a complete sphere or it can be less than a half-sphere e.g., the bottom third of a sphere. The bottom of the tip, while preferably a portion of a sphere, can also be a portion of any other convex curved figure of revolution, such as a paraboloid, an ovoid, a hyperboloid, a flattened sphere, etc. Accordingly, the reader is requested to determine the scope of the invention by the appended claims and their legal equivalents, and not by the samples which have been given.

I claim:

1. A tip for a cane for use by the visually handicapped wherein said cane has a shank and a bottom end of said shank, said tip comprising a substantially hollow contact element having an outwardly facing convex contact surface which is relatively broad in relation to the diameter of the bottom end of the shank of a cane to which it is attached, means for attaching said contact element to the bottom end of the shank of a cane such that the contact surface of said contact element acts as the tip of said cane; wherein said means for attaching being the only connection between said contact element and said cane; said contact element acting to amplify vibrations generated when contacting objects in a path of travel which are detectable by a user of the cane.

2. The cane tip of claim 1 wherein said contact element is a contact shell having a hollow interior region behind said contact surface.

3. The cane tip of claim 2 further comprising a reflector shell having a hollow interior region, said reflector shell being adapted for positioning on the shank of a cane in spaced relation behind said contact shell such that the hollow interior regions of said contact shell and reflector shell face each other to provide a reverberation region between said shells.

4. The cane tip of claim 3 wherein said contact shell and said reflector shell are hemispherical in shape.

5. The cane tip of claim 1 wherein said contact element has a hemispherical shape.

6. The cane tip of claim 1 wherein the breadth of said contact element is at least five centimeters.

7. A tip for a cane for use by the visually handicapped wherein said cane has a shank and a bottom end of said shank, said tip comprising a contact shell having an outwardly facing convex contact surface and a relatively large diameter in relation to the diameter of the bottom end of the shank of a cane to which it is attached, said contact shell acting to amplify vibrations generated when contacting objects in a path of travel which are detectable by a user of the cane, means for attaching said contact shell to the bottom end of the shank of a cane such that the contact surface of said contact element acts as the tip of said cane, wherein said means for attaching being the only connection between said contact element and said cane.

8. The cane tip of claim 7 wherein said contact shell is hemispherical in shape.

9. The cane tip of claim 7 wherein the diameter of said hemispherical contact shell is at least five centimeters.

10. A cane for use by the visually handicapped comprising a shank having a bottom end and a gripping end, a contact element secured to the bottom end of said shank which acts as the tip of said cane, said contact element having an outwardly facing hollow convex contact surface which is relatively broad in relation to the diameter of the bottom end of said shank; wherein said contact element amplifying acoustic vibrations generated when contacting objects in a path of travel; said contact element further includes secured means for attaching to the bottom end of said cane wherein said secured means being the only connection between said contact element and said cane.

11. The cane of claim 10 wherein said contact element is a convex contact shell extending about the bottom end of said shank to provide a hollow interior region thereat behind said contact surface.

12. The cane of claim 11 further comprising a reflector shell having a hollow interior region, said reflector shell being secured to said shank behind said contact shell and in spaced relation therewith such that the hollow interior regions of said contact shell and reflector shell face each other to provide a reverberation chamber between said shells.

13. The cane of claim 12 said contact shell and said reflector shell have a hemispherical shape.

14. The cane of claim 13 wherein said contact shell and said reflector shell have a diameter of approximately seven and one-half centimeters and are separated on said shank by approximately two centimeters.

15. The cane of claim 10 wherein said contact element has a hemispherical shape.

16. The cane of claim 10 wherein the breath of said contact element is at least five centimeters.

17. A cane for use by the visually handicapped comprising a shank having a bottom end and a gripping end, a hemispherical contact shell at the bottom end of said shank which acts as the tip of said cane, said contact shell having an outwardly facing convex contact surface which has a relatively wide diameter in relation to the diameter of the bottom end of said shank and which extends about the bottom end of said shank to provide a hollow interior region thereat behind said contact surface, and a hemispherical reflector shell having a hollow interior region, said reflector shell being secured to said shank behind said contact shell and in spaced relation therewith such that the hollow interior regions of said contact shell and reflector shell face each other to provide a reverberation chamber between said shells.

18. The cane of claim 17 wherein said contact shell and reflector shell have substantially the same diameter.

* * * * *